United States Patent [19]

Bengtsson

[11] 4,011,628

[45] Mar. 15, 1977

[54] HINGE MEANS FOR A PIVOTABLE WINDOW

[76] Inventor: Sigurd Walter Bengtsson, Bruksgatan 17, Goteborg, Sweden

[22] Filed: Oct. 1, 1975

[21] Appl. No.: 618,388

[30] Foreign Application Priority Data

Oct. 4, 1974 Sweden ..... 7412523

[52] U.S. Cl. ..... 16/140; 49/388

[51] Int. Cl.[2] ..... E05D 11/08

[58] Field of Search ..... 16/128 R, 135, 137, 16/139, 140, 141, 143, 146, 147, 148; 49/388, 389, 341

[56] References Cited

UNITED STATES PATENTS

| | | | |
|---|---|---|---|
| 2,569,109 | 9/1951 | Lidin | 16/140 |
| 2,948,916 | 8/1960 | Lewin | 16/140 |
| 2,979,761 | 4/1961 | Flodell | 16/140 |

*Primary Examiner*—G. V. Larkin
*Attorney, Agent, or Firm*—Hill, Gross, Simpson, Van Santen, Steadman, Chiara & Simpson

[57] ABSTRACT

A hinge means for a pivotable window includes a link, formed as a casing and enclosing two meshing gears connecting two pivots, of which one is adapted to be attached to the casement, and the other is adapted to be connected to the frame. These gears will govern the movement of the frame with respect to the link, and the movement of the link with respect to the casing, so the frame will swing about twice as much in relation to the casing as the link will do. Both gears cooperate with braking members at the link, so a continuous braking force is at hand all during a 180° turn of the frame. The attachment for the link at the frame includes a fitting and a fitting plate, having hook means and mating grooves, respectively shaped to ensure a safe retention of the frame in the casement, but permitting an easy mounting and dismounting of the frame.

8 Claims, 15 Drawing Figures

FIG. 8
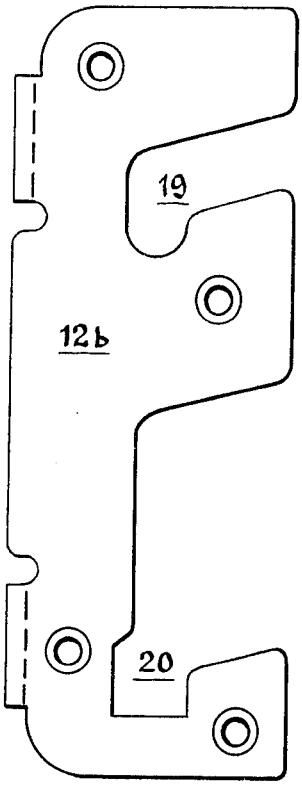
FIG. 10
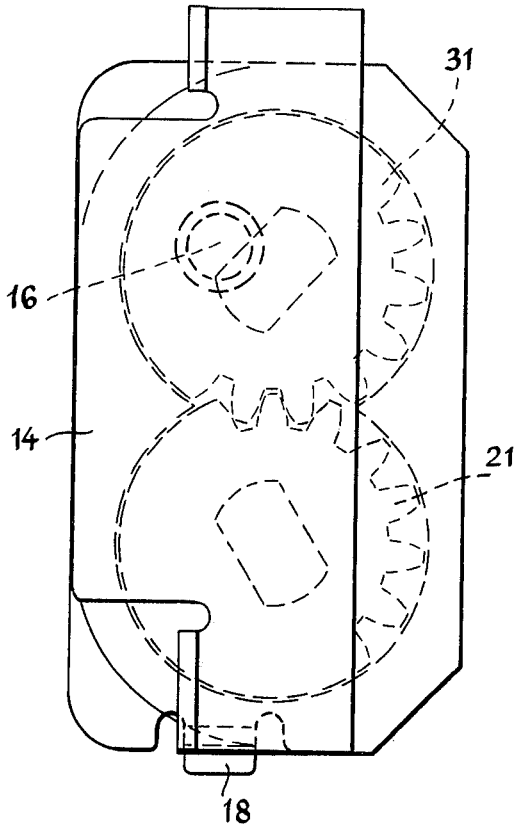
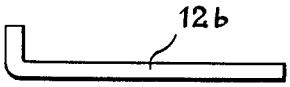
FIG. 9

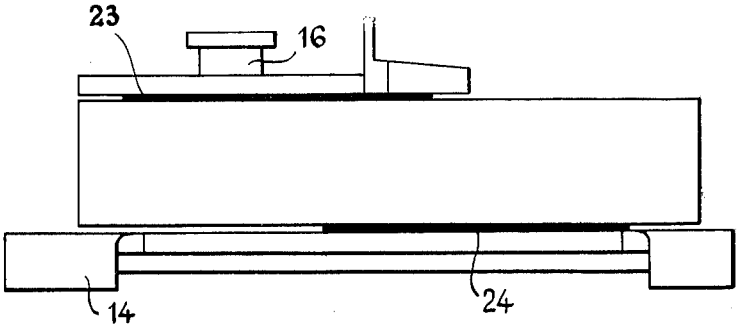
FIG. 13
FIG. 14
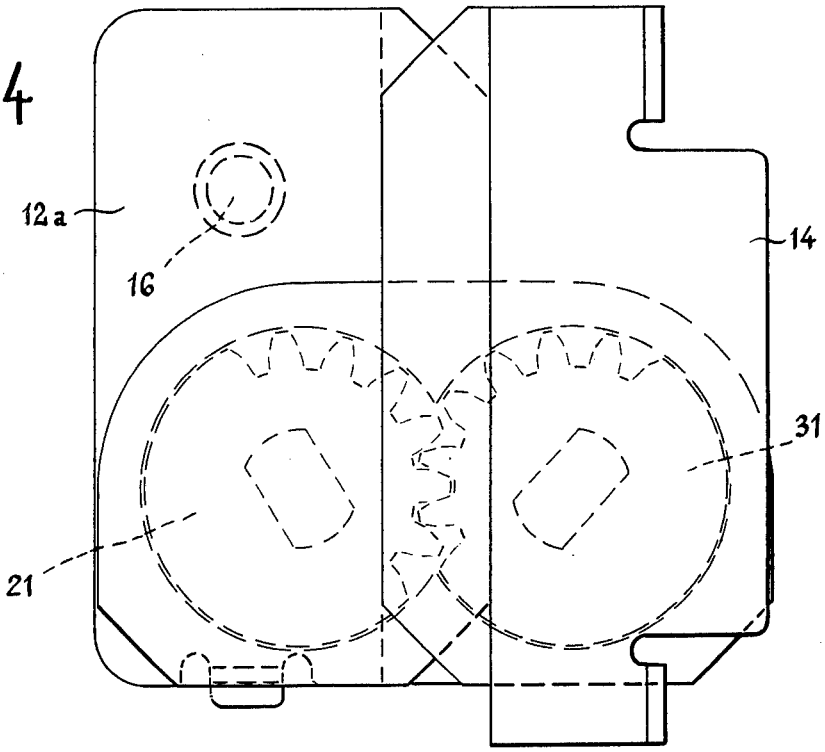
FIG. 15
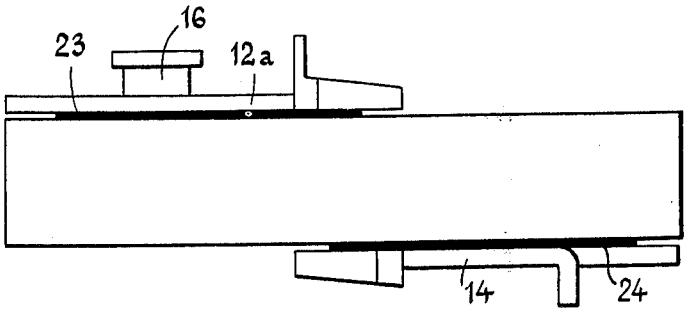

HINGE MEANS FOR A PIVOTABLE WINDOW

BACKGROUND OF THE INVENTION

1. Field of the Invention

This invention relates to hinges for casement windows.

2. Prior Art

When designing hinges for windows pivotable about a horizontal axis, located about centrally in the window opening, two main points must be considered. On the first hand the hinge shall permit a simple mounting and dismounting, respectively, of the frame with respect to the casement, while maintaining a safe retention of the frame therein, also when the frame has been swung about 180° for cleaning its outer pane, and on the other hand the hinge must contain frictional elements ensuring a smooth and well balanced turning movement.

There are a number of hinges available on the market having one frictional component between its attachment to the casement and to the frame, respectively, but with those hinges the frictional component will follow the frame during the initial 90° of the opening movement. During this initial turning movement a lower frictional center of the component is active. During the further 90° of a full turning movement an upper frictional center at the component is active. When the frame is being returned the initial 90° of the turning movement will occur about the upper center of the frictional component. Thereafter the frictional movement will accompany the frame so the remainder of the turning movement will occur about the lower frictional center of the frictional component.

Each frictional center in those hinges must have a frictional force sufficient to carry the full weight of the window, as each center will alone have to take care of the braking effect during part of the movement.

In order to provide the desirable possibility to mount the frame in the casement the hinge often includes a link, so the frame, after a 180° rotation, will be brought at least partly outside the sealing shoulder in the casement.

SUMMARY OF THE INVENTION

The desirable governed turning movement, which is controllable in each angular position, is according to the invention obtained if the link of the hinge is connected to the casement by means of a first pivot, and the frame is connected to the link by means of a second pivot, said two pivots being interconnected by way of the link in such a manner that the frame will perform a swinging movement in relation to the coaming, which is about twice as big as that performed by the link in relation to the coaming.

The pivot is preferably mounted at the casement by means of a fitting engageable with a link, said fitting being provided with two hook members, directed away from link and arranged to cooperate with a fitting plate at the casement have grooves open towards the operating side of the window, and adapted to permit a lifting of the frame in the vertical direction, and thereupon a movement about in the horizontal direction, upon the swinging of the frame 90° to 180° from closed position.

According to a further development of the invention the link is formed as a casing divided substantially along a longitudinal middle plane perpendicular to the pivots; the pivot at the casement is mounted upon a fitting cooperating with the casing; the pivot at the frame is mounted at a further fitting located at the opposite end of the casing; the two pivots are interconnected within the casing by means of components having a substantial extension parallel to the plane of division and braking elements at at least one of said pivots are fitted between the pertaining extended component and the casing and/or between the latter and the fitting at the coaming and the frame, respectively.

BRIEF DESCRIPTION OF THE DRAWINGS

FIG. 8 is an elevation of a fitting plate adapted to be attached to the casement and to receive the casement fitting of the hinge, FIG. 9 is an end view of the component shown in FIG. 8, FIG. 10 is an elevation of a complete hinge as viewed from the fitting at the frame, FIGS. 12 and 13 show views corresponding to FIGS. 10 and 11, when the casing has been swung 45°, and FIGS. 14 and 15 show corresponding views when the casing has been swung 90°.

DESCRIPTION OF A PREFERRED EMBODIMENT

Figure 1:
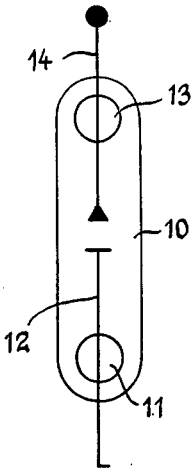
FIGS. 1 – 5 schematically show different positions of the link in relation to the casement and to the frame, respectively, during a 180° turning movement of the latter.

A so called pivotal window turns about a horizontal axis, and is provided with two hinges located about in the middle of the vertical side posts of the casement. The arrangement permits the upper part of the frame to be swung inwards when the window is to be opened. When the window is closed the sealing function presupposes that the upper part is pressed outwards against a shoulder in the casement, while simultaneously the lower part of the frame is forced inwards against a corresponding shoulder in the casement.

For cleaning the outward face of the window pane, or for cleaning the inward faces of the panes of a window having interconnected twin frames, the frame structure is swung 180°. The pivot axis should be located that much below the geometric middle axis of the casement, that the lower part of the frame may be swung past the sealing shoulder in the upper part of the casement, or the hinge must be designed in such a manner that the pivot axis will be lowered during an opening movement.

The latter is obtainable by providing the hinge with a link, which is connected to the frame and to the casement, respectively, by separate pivots. By means of such hinges, the frame may be brought completely away from the sealing shoulders, after having been swung 180° with respect to the coaming. This will largely facilitate a mounting and a dismounting of the frame with respect to the casement.

FIGS. 1 – 5 schematically show the function of a pivot hinge having a link 10. The link 10 is by means of a first pivot 11 connected to a casement fitting 12, and with a second pivot 13 connected to a frame fitting 14.

FIG. 1 shows the positions of the components when the window is closed. In order to illustrate the orientation of the components during the subsequent turning movement the casement fitting (when the window is closed) at its upper edge is provided with a cross bar, and at its lower edge with a laterally directed bar, while the frame fitting has a ball at its upper edge and a wedge at its lower edge.

The pivots 11 and 13 are fixedly mounted at the pertaining fitting at the casement or at the frame, respectively, and a relative turning movement between the pivots and the links will thus occur. In the manner to be described below the pivots are interconnected within the link in such a manner that the angular movement of the frame with respect to the casement will be about twice as big as that of the link with respect to the casement. It is of course necessary that the movement of the window, which often is large and heavy, occurs under full control at all opening angles, and therefore the braking function between the link and the pertaining fitting is of greatest importance.

Figure 5:
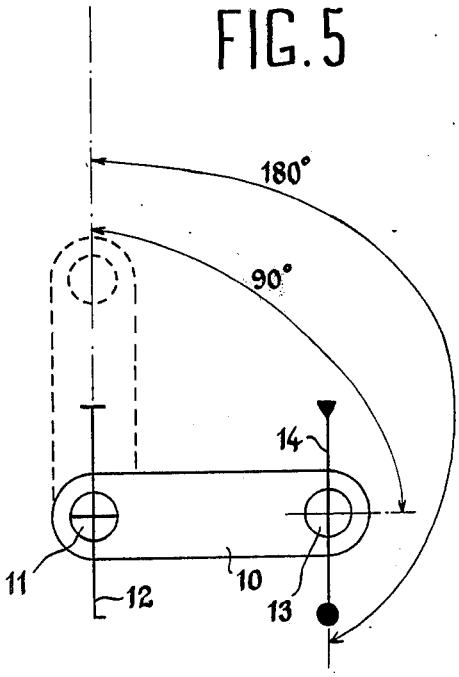

FIG. 1 shows, as mentioned above, the positions of the components when the window is closed, FIG. 5 shows the positions when the frame has been swung 180° and it should be noted that the link has been swung 90° in relation to the casement, and the frame has been swung 90° in relation to the link. By an addition of these two movements the frame will be swung 180° in relation to the casement.

Figure 2:
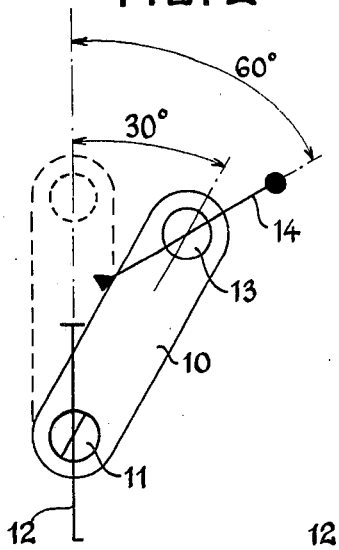
Figure 3:
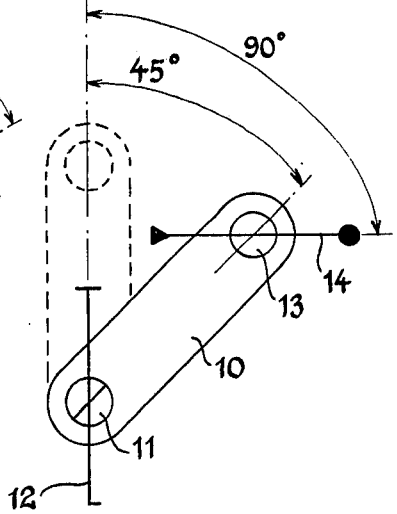
Figure 4:
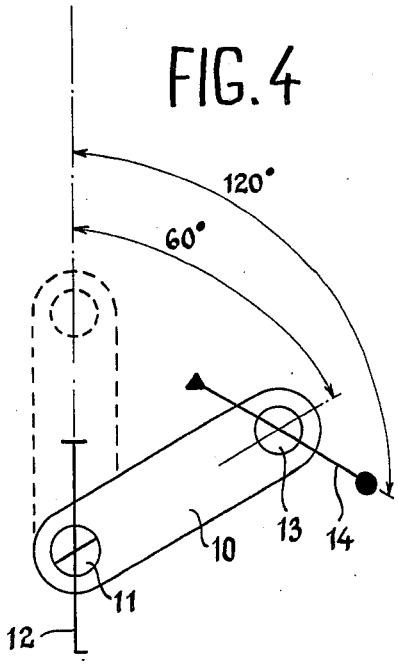

FIGS. 2, 3 and 4 show intermediate positions during the opening movement, when the link has been swung 30°, 45° and 60° respectively, and the frame simultaneously has been swung 60°, 90° and 120°, respectively.

The link 10 is formed as a casing, being divided in a longitudinal middle plane, perpendicularly with respect to the axis of the pivots. The pivots are connected to gears within the casing. The gears have about the same diameter and are interengaging. As they have to perform only a limited turning movement, only part of their circumference needs to be provided with teeth.

Figure 6:
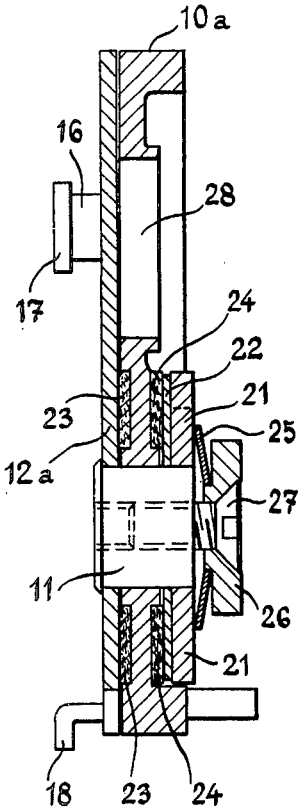
FIG. 6 shows a longitudinal section through one half of a casing (the link) with the turning pivot at the coaming in mounted position.
Figure 7:
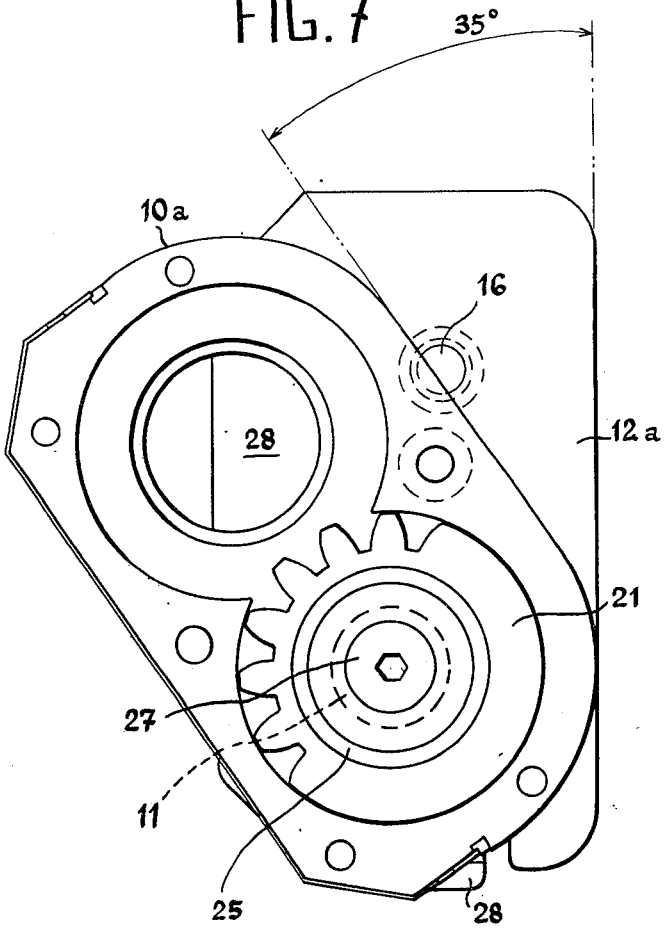
FIG. 7 is an elevation of this component, with the casing turned 35° in relation to the fitting of the casement.

FIG. 6 shows a longitudinal section through portion 10*a* of the casing (the link) pertaining the casement fitting, and FIG. 7 shows an elevation of this portion, when the casing has been turned 35° with respect to the casement fitting.

The other portion of the casing has basically the same appearance, but the pivot is of course located in the upper end of the casing, and the fitting 14 connected to the pivot 13 is adapted to be permanently attached to the frame.

Casement fitting 12 is adapted to make possible a simple but safe mounting of the frame within the casement, and comprises a fitting portion 12*a* connected to the casing as well as a fitting plate 12*b*, of the type illustrated in FIGS. 8 and 9, and adapted to be permanently attached to the casement.

Fitting portion 12*a* is at its upper end provided with hook members including a trunnion 16, having an enlarged head 17, directed away from the casing. At its lower end the fitting portion is provided with an outwardly bent tongue 18. The trunnion and the tongue are formed with due consideration to the thickness of the fitting plate 12*b*.

The latter is provided with an upper groove 19 for the trunnion 16, and with a lower groove 20 for the reception of the tongue 18. The fitting plate is mounted outside recesses in the casement so it is possible to move the head 17 of the trunnion, as well as the bent portion of the tongue inside of the fitting plate, when this has been attached to the casement, and it is evident that the trunnion and the tongue, respectively, during a mounting of the frame, will first be moved horizontally into the casement, and then be brought vertically downwards.

The entrance to each groove is defined by a lower, carrying edge, which is slightly inclined inwards/downwards with respect to a horizontal plane, and each groove includes a vertical portion the bottom of which is formed to accomodate the pertaining hook member, i.e., trunnion or tongue.

The cylindrical trunnions 16 facilitate the location of the frame in the upper grooves, and when the frame has been swung into the plane of the casement both hook members will slide inwards/downwards in the entrance portions of the grooves, and are then sunk along the vertical portions of the grooves.

In this manner the frame will be safely retained in the casement, even if the frame is swung 180° with respect to the casement. The frame may, however, easily be removed from the casement, by being first lifted vertically and then being retracted horizontally. The weight of the window ensures that such movements will never occur accidently.

As is best evident from FIG. 6 the pivot 11 is fixedly connected to the fitting portion 12*a*. A gear 12 is mounted upon the pivot and is located inside the casing. As mentioned above the gear is expected to perform a limited angular movement only, so only about one half of the gear is provided with teeth.

A washer 22, having about the same diameter as the external diameter of the gear, is fitted between the gear and the casing, and provides an un-interrupted frictional face.

Two annular grooves are formed in the pertaining portion of the casing, concentrically with the trunnion, and into these grooves frictional elements 23 and 24, respectively, are fitted. These elements cooperate with the fitting portion 12*a* and washer 22, respectively. The washer 22 and the gear are non-rotatably located on the pivot, but may be axially displaced along the pivot.

The gear and the washer are forced against the casing by means of a spring washer 25, which is supported by a further washer 26 which is mounted upon a screw 27 passing through its center; by turning the screw, the appropriate spring pressure may be applied to the frictional elements.

In the upper end of this portion of the casing a cylindrical opening 28 is provided, which is adapted, when the housing is complete, to accomodate the further washer 26 at the opposite portion of the casing.

This opposite portion of the casing is, as mentioned above, basically similar to the portion described, and it is evident that it will be possible, after moving the pertaining (casement or) frame fitting to the side, to obtain access to the screw 27 by way of the opening 28 in the juxtaposed portion of the housing, in order to adjust the frictional pressure.

Figure 11:
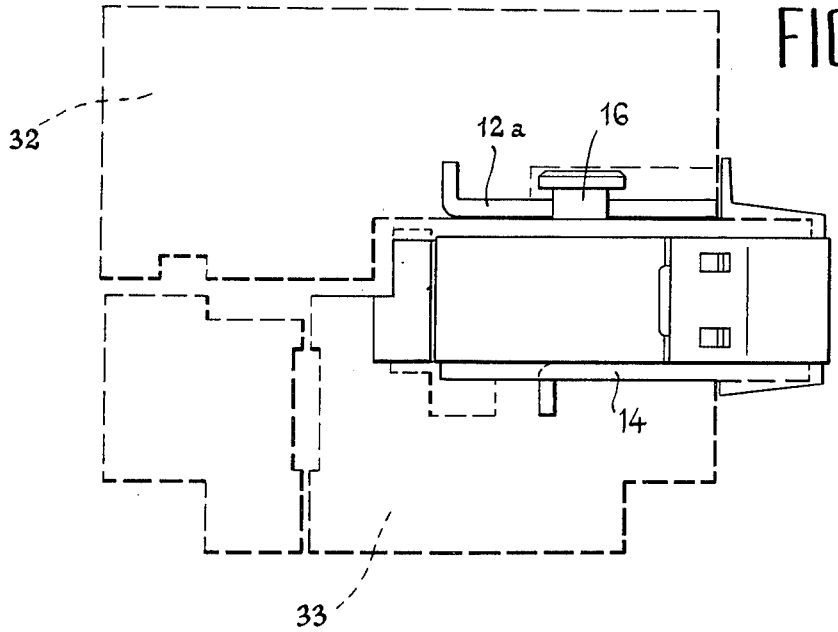
FIG. 11 shows a view of the hinge of FIG. 10, as viewed from above, and with the casement and the frame indicated in broken lines.
Figure 12:
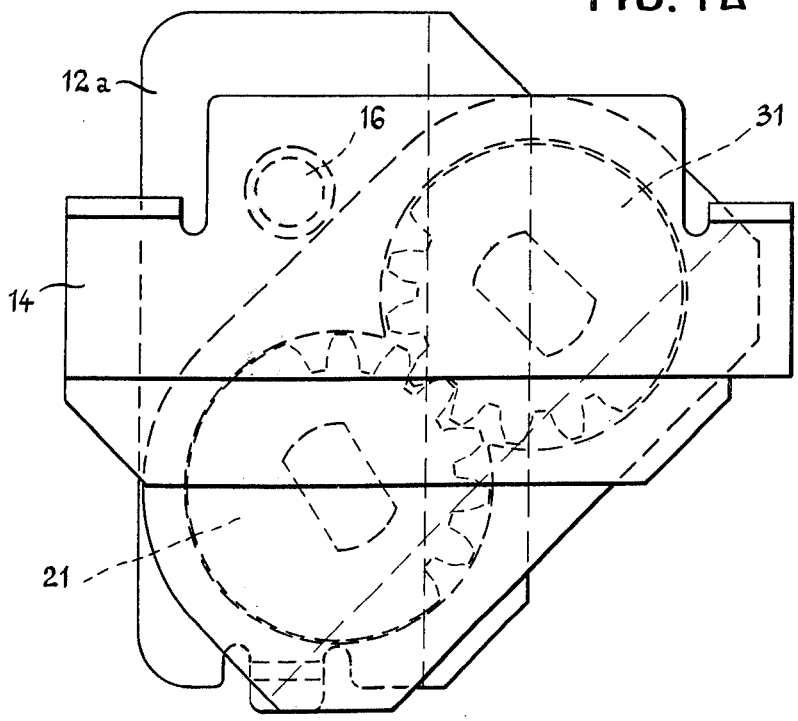

FIGS. 10 and 11 show a complete hinge. FIG. 10 is drawn as viewed from the frame fitting. FIG. 10 in broken lines further shows gear 31 connected to the frame fitting as well as the gear 21 connected to the casement fitting, and the interengagement of the gears is also shown. FIG. 11 in broken lines further shows the adjacent portions of the casement 32 and the frame 33, respectively. When the window is closed only a small portion of the hinge will be exposed to the room. A cover plate of arbitrary material and of suitable color may be fitted to the hinge so this will harmonize with the window and its surroundings.

FIGS. 12, 13 and 14, 15 respectively, show views corresponding to those of FIGS. 10 and 11, with the window partly and fully opened, respectively.

The two frictional centers around the pivots are always communicating by way of the gears. With known designs of hinges having separated frictional centers, one or both frictional forces may be altered after some time of use, whereby an undesirable change in the turning resistance occurs during the movement of the frame. This may cause the person opening the window to lose his grip upon the frame, if a hard friction suddenly is transferred into a lighter friction.

According to the present invention the combined frictional force will always be at hand, so no change in turning resistance will ever be noticed, when the frame is passing a particular angular position.

As no transfer of activity from one frictional center to the other will occur a further advantage will be found in that no angular position lacking friction, i.e. where play can occur, will be found, which is often the problem with designs where the frictional centers are functioning alternatingly.

As mentioned above it is possible to adjust the frictional centers individually by means of the screws 27. Alternatively only one of the centers is made adjustable, while the other during the assembling of the hinge is subjected to a pre-selected frictional force. This ensures that the hinge will never fully lack frictional force, due to faulty handling or adjustment.

What I claim is:

1. In a hinge means for a window comprising a casement and a frame pivotable about a horizontal axis with respect to said frame said hinge means including a link having first and second pivots at its opposite ends for attachment to the casement and to the frame respectively, as well as means interconnecting said first and said second pivots so as to cause a controlled turning movement of said frame in relation to said casement, the improvement of attachment means at said first pivot, including a fitting rigidly connected to said first pivot and a fitting plate for attachment to the casement, two hook members on said fitting, located one above the other and directed away from said first pivot, two grooves on said fitting plate for the reception of said hook members, each of said grooves having an entrance portion, open towards the inward side of the window, and being mainly horizontally directed, as well as a mainly vertical, downwardly directed portion, forming an extension of the inward end of said entrance portion.

2. A hinge means according to claim 1, in which the upper of said hook members is formed as a trunnion having an enlarged head, which the lower of said hook member is formed as a tongue presenting a carrying face perpendicular to said fitting.

3. A hinge means according to claim 1, in which the lower edge defining each of said grooves is slightly inclined inward/downwards with respect to a horizontal plane, the bottom of each of said vertical portions being shaped to accommodate the pertaining hook member.

4. A hinge for pivoting a window frame about a horizontal axis with respect to a casement, said hinge comprising:

a. a first pivot adapted to be secured to the casement;

b. a second pivot adapted to be secured to the window frame;

c. a link having connections with said pivots, said link being a hollow casing;

d. a pair of interengaging gears rotatably supported within said casing and respectively secured to said first and second pivots; and e. braking means acting between each of said gears and said casing;

whereby the window frame is enabled to be pivoted with respect to said link by an amount corresponding to the movement of said link with respect to the casement.

5. A hinge according to claim 4 in which each of said gears is non-rotatably; but axially displaceably mounted on the pertaining one of said pivots, and spring means urging each of said gears in the direction of the connection between said pivot and said casing.

6. A hinge according to claim 4 in which said braking means includes a friction washer and a braking element, said friction washer engaging said gear and said braking element, the latter engaging said casing.

7. A hinge according to claim 4 in which said hollow casing is divided substantially in a longitudinal central plane into two casing sections, each of said sections supporting one of said gears.

8. A hinge according to claim 7 in which each casing section has two annular grooves concentric with one of said pivots, said grooves having substantially the same diameter as said gears, and adapted each to accommodate a braking element of said braking means.

* * * * *